US010799000B2

(12) United States Patent
Heim et al.

(10) Patent No.: US 10,799,000 B2
(45) Date of Patent: Oct. 13, 2020

(54) NORDIC WALKING POLE HAVING A BUFFER

(71) Applicant: LEKISPORT AG, Baar (CH)

(72) Inventors: Eberhard Heim, Unterensingen (DE); Tobias Böing, Grossbettlingen (DE)

(73) Assignee: LEKISPORT AG, Baar (CH)

( * ) Notice: Subject to any disclaimer, the term of this patent is extended or adjusted under 35 U.S.C. 154(b) by 0 days.

(21) Appl. No.: 16/093,995

(22) PCT Filed: Jun. 19, 2017

(86) PCT No.: PCT/EP2017/064870
§ 371 (c)(1),
(2) Date: Oct. 16, 2018

(87) PCT Pub. No.: WO2018/007135
PCT Pub. Date: Jan. 11, 2018

(65) Prior Publication Data
US 2019/0125045 A1 May 2, 2019

(30) Foreign Application Priority Data
Jul. 8, 2016 (CH) ..... 878/16

(51) Int. Cl.
*A45B 9/04* (2006.01)

(52) U.S. Cl.
CPC ..... *A45B 9/04* (2013.01); *A45B 2200/055* (2013.01)

(58) Field of Classification Search
CPC .... A45B 9/04; A45B 2200/055; A61H 3/0288
See application file for complete search history.

(56) References Cited

U.S. PATENT DOCUMENTS

| | | | | |
|---|---|---|---|---|
| 47,265 | A * | 4/1865 | Allamby et al. | A45B 9/04 135/81 |
| 415,511 | A | 11/1889 | Howgate | |
| 3,901,258 | A | 8/1975 | Montgomery | |
| 4,669,752 | A * | 6/1987 | Jackson | A63C 11/24 280/824 |
| 6,203,064 | B1 * | 3/2001 | Zaltron | A63C 11/24 280/824 |
| 6,216,713 | B1 | 4/2001 | Kennan | |

(Continued)

FOREIGN PATENT DOCUMENTS

| | | |
|---|---|---|
| CN | 203952662 U | 11/2014 |
| DE | 694 731 C | 8/1940 |

(Continued)

OTHER PUBLICATIONS

International Preliminary Report on Patentability of PCT/EP2017/064870 dated Jan. 10, 2019.

(Continued)

*Primary Examiner* — Noah Chandler Hawk
(74) *Attorney, Agent, or Firm* — Sughrue Mion, PLLC

(57) ABSTRACT

The invention relates to a Nordic walking pole, comprising a pole tube (2), at the lower end of which an attachment (3) is provided, to which attachment a buffer (4) of rubber-elastic material is detachably fastened. The buffer according to the invention has an insert (5) of hard material in a central cut-out. Said insert is fastened to the attachment in order to connect the buffer to the pole.

24 Claims, 6 Drawing Sheets

(56) References Cited

U.S. PATENT DOCUMENTS

| | | | | |
|---|---|---|---|---|
| 8,800,580 | B2 * | 8/2014 | Heim | A45B 9/04 135/78 |
| 10,045,905 | B1 * | 8/2018 | Ayre | A61H 3/0288 |
| 10,080,698 | B1 * | 9/2018 | Ayre | A61H 3/0288 |

FOREIGN PATENT DOCUMENTS

| | | | | |
|---|---|---|---|---|
| DE | 9104950 | U1 * | 8/1991 | A45B 9/04 |
| DE | 298 07 586 | U1 | 8/1998 | |
| DE | 103 40 135 | A1 | 3/2005 | |
| DE | 20 2007 013 027 | U1 | 12/2007 | |
| DE | 10 2010 022 042 | A1 | 12/2011 | |
| EP | 1 814 419 | B1 | 6/2011 | |
| FR | 1 002 013 | A | 3/1952 | |
| GB | 371 766 | A | 4/1932 | |
| WO | 2006/128312 | A1 | 12/2006 | |
| WO | WO-2006136691 | A2 * | 12/2006 | A45B 9/04 |
| WO | 2008/037098 | A1 | 4/2008 | |
| WO | 2011/128231 | A1 | 10/2011 | |

OTHER PUBLICATIONS

International Search Report for PCT/EP2017/064870 dated Jul. 17, 2017 [PCT/ISA/210].

* cited by examiner

NORDIC WALKING POLE HAVING A BUFFER

CROSS REFERENCE TO RELATED APPLICATIONS

This application is a National Stage of International Application No. PCT/EP2017/064870 filed Jun. 19, 2017, claiming priority based on Switzerland Patent Application No. 00878/16 filed Jul. 8, 2016.

TECHNICAL FIELD

The present invention relates to a pole for use as sports equipment, in particular as a Nordic walking pole according to the features of the preamble of claim 1, and also to a buffer for a Nordic walking pole of this kind.

STATE OF THE ART

A plurality of Nordic walking poles is known from the prior art. Abrasion of the rubber-elastic buffers means that there is already a plurality of variants of poles with an exchangeable buffer, such as in DE 20 2007 013 027 U1, for example, in which the buffer is secured by means of a ball locking device to the lowermost pole portion, or in DE 103 40 135 A1, which discloses a screw connection or a latching connection.

In addition, there is a need for poles which have an extendable tip, so that the pole can be adapted to changing terrain.

Known from WO 2008/037098 is a Nordic walking pole which comprises a pole body at the lower end whereof a tip body and a buffer are provided. The buffer is mounted displaceably so that it can be fixed in an axial direction to the pole body. The buffer can be fixed in at least two axially different positions by means of a positive connection in relation to the pole body. The tip body and/or the lowermost portion of the pole body in this case are arranged to pass through a central opening of the buffer and the buffer can be fixed in an axial direction to the pole body in this central opening. WO 2011/128231 A1 discloses a buffer which is height-adjustable by means of latching levers which can conceal the tip when it is not in use. However the buffer thereon is not designed to be exchangeable. In DE 10 2010 022 042 A1 and EP 1 814 419 an exchangeable rubber buffer is disclosed in connection with an extendable tip body. In both cases, however, the rubber buffer is simply fitted to a lower end of an attachment on the end of the pole in a frictionally engaged manner.

The disadvantage of poles of the prior art is the unsecure connection between the exchangeable buffer and the pole, particularly in models with an extendable tip or height-adjustable buffer. The hidden disadvantage of models with a purely frictionally engaged connection is that the buffer can become distorted on the end of the pole, which is problematic particularly in the case of asymmetric buffers, as a certain rotational position on the pole is required for use. In addition, adjustable pole tips are susceptible to dirt. Moreover, particularly in the case of wet paths, dirt can accumulate between the pole tip and the pole tube. Since there should only be a small amount of play between the pole tip and the pole tube, the penetration of dirt can hinder or even entirely prevent any movement of the pole tip. Furthermore, with systems of this kind, the buffers cannot be replaced without the assistance of tools.

PRESENTATION OF THE INVENTION

Accordingly, the problem addressed by the present invention is that of providing an improved exchangeable buffer for a pole, in particular for a Nordic walking pole, which overcomes the disadvantages of the prior art. In particular, a problem addressed by the invention is that of providing a simple and reliable system for attaching an exchangeable buffer to a Nordic walking pole, the buffer whereof is mounted on the pole in an axially displaceable manner or which at the same time allows there to be a simple switch between a position with the tip extended and a position with the tip retracted.

The present invention presents a pole of this kind with an exchangeable buffer according to claim 1. Depending on the requirements, the user can easily exchange the buffer, for example buffers with different degrees of hardness, or if the buffer is replaced due to abrasion of the rubber-elastic material. In addition, the proposed system of buffer replacement allows for simple production of the buffer to be exchanged.

The pole according to the invention, in particular the Nordic walking pole, has a pole tube on the lower end whereof is provided an attachment to which a buffer made of rubber-elastic material is detachably secured. This exchangeable buffer has an insert made of hard material which is secured in a central recess of the buffer which is designed to be upwardly open in a direction to the attachment of the pole.

The buffer is therefore formed as a two-part component having a securing region made of a substantially inflexible hard plastic and having an elastomeric region forming the rolling surface. In this case, the rubber-elastic or elastomeric region is preferably made of an elastomeric material such as thermoplastic elastomers, for example, like TPE, TPU, for example (TPU=urethane-based thermoplastic elastomers), silicon or vulcanized rubber. Spikes can also be let into the rolling surface of the buffer attachment, as is known from WO 2006/128312.

A preferred Nordic walking pole according to the present invention has an asymmetrically configured buffer. This has, measured parallel to the longitudinal axis of the pole, viewed in a front region in the running direction, a shorter length than in a rear region.

The insert used as the securing region which is received in a recess in the elastomeric region of the buffer is preferably formed from a substantially inflexible hard plastic. The insert in this case may, for example, be a fiberglass-reinforced plastic and/or a plastic produced by extrusion molding. Formed parts made of cast materials (including metal) or machined materials are possible. The insert may be inserted in the buffer and secured therein in a force-fitting or form-fitting manner and possibly, in addition, in a substance-bonded manner; a purely substance-bonded connection is also possible. The insert preferably made of hard plastic is typically inserted in the rubber-elastic buffer, injected therein, extrusion-coated by elastomers and/or adhered. The insert is preferably designed as a hollow cylinder.

The central recess in the buffer may be configured either as a through-opening leading to the rolling surface, wherein the upper portion of the central recess preferably has a greater diameter than the lower region facing the rolling surface. In this way, on the boundary surface between the larger-diameter region and the smaller-diameter region an abutment or else a lower contact surface for the insert is formed. The central recess may, however, also be entirely closed downwards by a base, i.e. in the case of simple buffers which are not penetrated by a tip, have a substantially pot-shaped design.

In other words, the central recess in the buffer may be a blind hole with a downwardly at least partially closed base. In this case, an upper portion of the central recess facing the attachment is preferably substantially cylindrical in design. The underside of the rubber-elastic buffer forms the preferably profiled rolling surface. The rolling surface is preferably configured asymmetrically and is, in particular, raised further towards the front in the running direction in order to be optimally matched to the running movement for Nordic walking. A tip may pass through this rolling surface, preferably approximately in the rear third. In addition, the profiling preferably has side extensions.

In the case of the pole according to the invention, the buffer is detachably fastened to the attachment of the pole by means of a bayonet lock between the insert and the attachment. The form fit ensures a constructively simple but as secure as possible fixing is guaranteed which is scarcely susceptible to dirt.

According to a first preferred embodiment, the buffer can be secured in only a single rotational position on the attachment of the pole, wherein the attachment and/or the buffer has a distortion lock to prevent rotation of the buffer in respect of the attachment in a state fitted to the pole. The pole advantageously has a distortion locking means between the attachment and the insert, particularly preferably by form-fitting. As an alternative or in addition to this, the pole has a distortion locking means between the attachment and the buffer, particularly preferably by form-fitting and/or force-fitting and/or substance bonding.

According to a further preferred embodiment, the attachment has a lower portion facing the buffer, the cross section whereof is not circular. This lower portion advantageously has a greater width in the running direction than in a direction perpendicular to the running direction. Particularly preferably, the lower portion of the attachment is configured as a flat cylinder. This has a first right wall, a second right wall opposite the first right wall and a third front wall and a fourth rear wall opposite the third front wall. In this case, the first wall and the second wall are preferably planar and the third wall and the fourth wall are curved in design. When the buffer is mounted, the lower portion of the outer sleeve preferably has a greater width in the running direction than perpendicularly to the running direction, likewise the lower portion of the inner sleeve, wherein these lower portions are preferably both configured as flat cylinders. The shape of the lower portion of the inner sleeve is configured to match the shape of the lower portion of the outer sleeve or else the lower portion of the inner sleeve precisely matches the lower portion of the outer sleeve.

The insert of the buffer which is preferably substantially configured as a hollow cylinder has at least a first recess on an inner wall of the insert, for example a groove or an undercut for receiving a first radial projection which is arranged on a lower portion of the attachment facing the buffer. The insert preferably has in addition a second recess radially opposite the first recess for receiving a second projection of the attachment radially opposite the first projection.

The two radial recesses lying opposite one another each extend in the circumferential direction beyond only part of the circumference of the insert and in only one region beyond the entire axial length of the insert. The recesses therefore constitute regions with a smaller wall thickness or else insert thickness, compared with the remaining circumferential region of the insert.

One of the radial recesses is interrupted or divided into two halves by a rib extending in the axial direction parallel to the longitudinal axis of the pole. However, this rib only extends beyond a first axial portion of the insert, so that the projections on the attachment are rotatable within this region of the insert. When the buffer is fitted to the lower portion of the attachment, this rib projects into a radial recess on a projection of the lower portion of the attachment and therefore fixes the slide-on position of the attachment onto the attachment. The second recess is preferably bisected in the circumferential direction by an axial rib of this kind preferably extending along the longitudinal axis of the pole only incompletely over an axial length of the insert on the inner wall of the insert. The second projection of the attachment is interrupted by an axial gap which is suitable for receiving the axial rib of the insert.

When the buffer is in a secured position on the attachment or on the pole, a bisecting sectional plane of the attachment arranged along the longitudinal axis of the pole, which sectional plane runs through the two radial projections, is distorted in the circumferential direction in relation to a bisecting sectional plane of the insert running along the longitudinal axis of the plane, which sectional plane runs through the two recesses lying opposite one another. In this case, the bisecting sectional plane of the attachment running along the longitudinal axis of the pole runs parallel to the running direction.

Each radial projection on a lower portion of the attachment reaches below a shoulder running in the circumferential direction on the inner wall of the insert of the buffer secured to the attachment. In this case, the respective shoulder forms on the inner wall of the insert an upper abutment for the respective projection of the attachment.

The radial recesses on the inside of the insert are roughly L-shaped with a wide neck extending parallel to the longitudinal axis of the pole and a narrower leg in the circumferential direction. They extend in a lower portion (leg) which borders on the lower edge of the insert, over a longer circumferential portion of the insert than in an upper region (neck), viewed from above in a clockwise direction along the longitudinal axis of the pole. The leg of the L-shaped radial recess in each case does not extend right up to the next recess, however. In this way, an abutment extends at two points in the circumferential direction of the insert over the entire axial length of the insert, wherein this abutment, viewed from above, borders on the right side of the lower portion of the first recess in each case and the left side of the second or next recess in a clockwise direction in the circumferential direction. Consequently, the projections on the lower portion of the attachment, once they have been introduced into matching recesses in the insert, are movable when the attachment is twisted clockwise in the circumferential direction relative to the insert or the buffer up to the respective abutment of the two axially extending abutments lying radially opposite one another in the respective leg of the recess which to some extent acts as a "rail". The projections at the lower end of the attachment therefore engage when twisted with these lengthened circumferential portions of the radial recesses.

An axial movement of the attachment from the insert is prevented by the abutment of the projections on the respective portion of the hollow cylinder with a greater wall thickness adjoining the lengthened circumferential portion (leg of the L).

The buffer is secured to the pole or the insert to the attachment via a plug-in/rotate movement. The two parts to be connected are inserted in one another in the correct position, i.e. the buffer with its insert is fitted to the lower portion of the attachment in a plug-in direction along the longitudinal axis of the pole and then rotated thereon. This involves a rotational movement of the insert relative to the attachment, or vice versa. The pole is preferably rotated clockwise with the attachment fastened thereto, while the buffer is held fixed, or vice versa, in that the buffer with the insert is rotated counter-clockwise, while the attachment is fixed. In order to detach the buffer from the pole or from the attachment, either the buffer or the attachment is rotated correspondingly counter-clockwise. The securing of the buffer to the pole need only be released when the rubber buffer has to be replaced, e.g. due to wear or due to a change of buffer type.

The fitting position and/or locked end position may, in addition, be marked on the rubber buffer and/or on the outer sleeve (for example by an imprint and/or molded symbols).

When the buffer is fitted onto the attachment, the first sectional plane of the insert which bisects the two recesses lying radially opposite one another, and the second sectional plane of the attachment which bisects the two projections of the attachment lying radially opposite one another and preferably also runs through the axial rib, are parallel to one another, wherein the two axes are not arranged parallel to the running direction V or to the sectional plane or else the axial plane of symmetry A-A in FIG. 1*f* or B-B in FIG. 2*f*, but twisted at between 45-90 degrees thereto. On the other hand, when the buffer is secured, these planes are twisted in respect of one another, wherein the second sectional plane of the attachment is arranged parallel to the running direction V.

The buffer preferably has on its inner wall at least one, preferably a plurality of, recesses in the circumferential direction and particularly preferably at different axial positions along the length of the upper portion of the central recess of the buffer. These recesses in the rubber-elastic region are each used to receive a radial flange arranged on an outer wall of the insert, extending sectionally in the circumferential direction.

The substantially hollow-cylindrical insert in the buffer preferably has on its outside two radial flanges arranged at different axial positions along the longitudinal axis of the pole arranged sectionally in the circumferential direction, spaced apart from one another and opposite one another. Said flanges engage with corresponding recesses on the inner wall of the buffer and prevent the insert from becoming detached from the buffer, particularly when the buffer is fitted onto the attachment and when the buffer is twisted in relation to the attachment, and locks the rotational position of the insert in the buffer.

In a particularly preferred embodiment, the attachment has at its lower end facing the buffer a projection extending in the direction of the longitudinal axis of the pole up to the buffer, preferably in the shape of an axial lug. This axial projection engages with a corresponding third recess on an outside of the buffer secured to the attachment, i.e. in the rubber-elastic region thereof. This likewise contributes to the fixing of the rotational position of the buffer on the attachment or to a rotational locking between the buffer and the attachment. This lug is preferably arranged in the front region, viewed in the direction of travel, when the pole is in use.

In order to guarantee the connection between the buffer and the attachment, a catch can also be used in addition. Other mutually corresponding or matching forms of recess or notch on the one part and protrusion on the other part to those described can also be used, including between the insert and attachment or between the insert and buffer. A particularly preferred pole according to the invention has an exchangeable buffer, the position whereof is adjustable relative to a pole tip. For this purpose, the attachment has a tip which is arranged passing through a central recess of the buffer and of the insert. On a pole of this kind, either the tip is arranged in a height-adjustable manner relative to the buffer, or vice versa. The tip or the buffer can preferably be locked at at least two axially different positions via a form-fitting connection.

In the case of poles with a height-adjustable tip, the insert has a hole for passage of the tip or else is configured as a hollow cylinder. In the case of poles without the passage for the tip in the buffer, the insert may likewise be pot-shaped, i.e. configured with a closed base.

If the pole has no relative axial displaceability from the tip to the buffer, the buffer is releasably secured at the lower end of the attachment which is formed, rather than from an outer sleeve or an inner sleeve, only from a single sleeve secured to the lower end of the (lowermost) pole tube portion or from another securing element provided at the lower pole end.

In a very simple embodiment, the attachment is directly secured to the lowermost pole tube portion and a simple buffer is then secured to the lower portion of this attachment by means of a bayonet lock for the purpose of exchange. In order to secure the buffer, the insert arranged in the buffer is secured straight to the lower portion of the attachment by means of a bayonet lock. If the attachment is partially axially displaceable, in order to expose or conceal the tip, in accordance with a preferred embodiment, the attachment is configured in two parts as an inner sleeve and an outer sleeve, wherein the tip is fixed to the inner sleeve and the outer sleeve is fastened thereto in an axially displaceable manner or else via a latching lever.

An inner sleeve of this kind may also have an exchangeable design in that, for example, its central recess has a form-fitting and/or three-fitting connection to an additional connection element not shown in the figures which, in turn, is secured to the lowermost pole tube portion. A form-fitting and/or force-fitting connection of this kind may, for example, be provided by a thread or a latching connection.

The tip is preferably made of wear-resistant material such as metal, hard metal, ceramic or a combination of these materials, for example, wherein the tip is typically fixed via a securing element made of metal or hard plastic to the inner sleeve.

A particularly preferred embodiment of a height-adjustable buffer is realized in a pole, the attachment whereof comprises an inner sleeve secured to the pole tube and an outer sleeve enclosing the inner sleeve and mounted thereon in an axially displaceable manner. In this ease, the attachment is provided with a tip, wherein the tip and/or a lowermost portion of the inner sleeve is/are arranged passing through a central recess in the buffer and a central recess in the insert. The buffer is mounted displaceably so that it can be fixed in an axial direction along a longitudinal axis of the pole in this central recess and can be locked in at least two axially different positions via a form-fitting connection in respect of the pole tube. For the axial height adjustment, a latching lever is articulated at its lower end facing a rolling surface of the buffer on the outside on the outer sleeve. At its upper end in the secured position of the buffer, the latching lever engages around the pole tube and/or the inner sleeve at least partially with a form fit. The latching lever can be released by pivoting it away from the outer sleeve.

The rubber-elastic buffer can be replaced by the same bayonet connection as described above. Rather than at the lower end of a simple attachment, in this case the exchangeable buffer which has a through-opening for the tip is fastened to the lower portion of the outer sleeve.

The present invention also relates to a buffer for a pole, as described above. The exchangeable buffer or replacement buffer according to the invention has a region made of rubber-elastic material and a preferably cylindrical central recess which is designed to be upwardly open. In the central recess, an insert made of hard material is secured, preferably by form-fitting and/or force-fitting, wherein the buffer is configured to be detachably secured to the attachment of the pole by means of a bayonet lock between the insert and the attachment. This buffer can preferably be secured in only a single rotational position on the attachment of the pole, wherein the buffer has a distortion locking means to prevent rotation of the buffer in respect of the attachment in a state fitted to the pole. The buffer preferably has a distortion locking means between the attachment and the insert, particularly preferably by form-fitting. In addition or alternatively, the buffer may have a distortion locking means between the attachment and the rubber-elastic region of the buffer, particularly preferably by form-fitting.

A particularly preferred buffer has a central recess configured in the form of a through-opening for receiving a pole tip. An upper portion of the through-opening in which the insert is secured preferably has a greater diameter than a lower portion of the through-opening which faces a rolling surface of the buffer. This means that the insert has a lower abutment on a boundary surface or on the base of the buffer between the upper portion with a larger diameter and the lower portion with a smaller diameter of the central recess.

In a particularly preferred embodiment, the insert is located in the snapped-in position in a rotational position in the central recess of the buffer, in which the two radially opposite recesses of the insert lie opposite in the circumferential direction of the pole twisted in respect of the running direction, preferably twisted by 45-90 degrees. In other words, an axially bisecting sectional plane through the two recesses in the insert lying opposite one another is arranged twisted relative to a running direction.

The second bisecting plane parallel to the pole axis through the attachment or through the two projections of the attachment runs parallel to the first left and second right wall of the attachment in the lower portion. In the fastened state of the buffer, this plane runs parallel to the sectional plane or axial plane of symmetry of the buffer and parallel to the running direction. However, when the buffer is fitted onto the attachment it runs in a twisted manner relative to the plane of symmetry of the buffer and therefore also in the circumferential direction twisted relative to the running direction.

The bayonet lock between the hard insert of the buffer and the attachment or the outer sleeve may, as an alternative to the described variants, also be facilitated by other forms of projections on the lower portion of the attachment and corresponding recesses in the insert, or vice versa, or, for example, by a radial pin on the inner surface of the insert which is introduced into a corresponding guide recess in the lower portion of the attachment and rotated therein, or vice versa. A further alternative would be an angled elongate hole arranged in the attachment, in which axial portion at least one pin secured to the insert is introduced axially by sliding on the buffer and then moved by rotation in the circumferential direction of the pin into the angled portion of the elongate hole, as a result of which the buffer is held in its axial position and in the rotational position, possibly along with a distortion lock.

The content of WO 2011/128231 A1 with reference to the height-adjustment mechanism of the buffer or for the exchange mechanism between the buffer and tip is included in the disclosure content of this application.

Further exemplary embodiments are described in the dependent claims.

BRIEF DESCRIPTION OF THE DRAWINGS

Preferred embodiments of the invention are described below with reference to the drawings which are only intended as an illustration and should not be interpreted as limiting. In the drawings.

DESCRIPTION OF PREFERRED EMBODIMENTS

Figure 4:
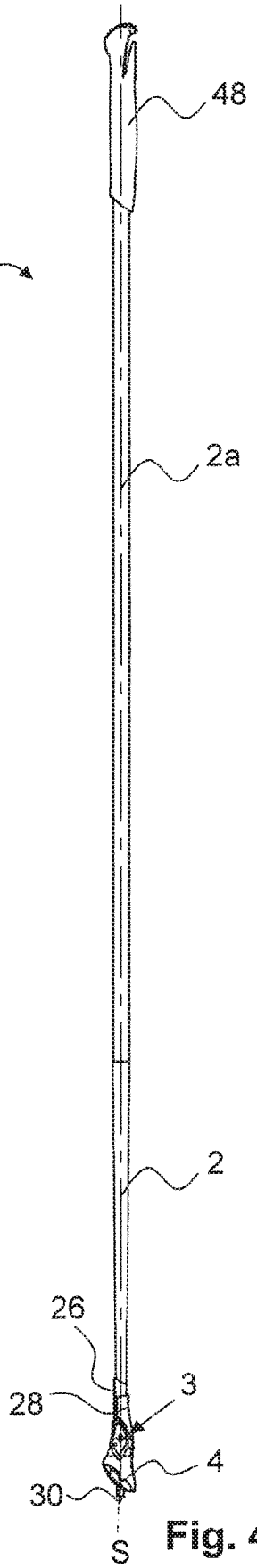
FIG. 4 shows a schematic representation of a pole with a buffer in accordance with the first exemplary embodiment with a projecting pole tip.

FIG. 4 depicts a pole 1 according to the invention, in this case a Nordic walking exhibiting a pole handle 48 and also an upper pole tube portion 2*a* and a lower pole tube portion 2. The attachment 3 with the buffer 4 secured thereto is secured to the lower end of the lower pole tube portion 2. If the pole has only a single pole tube, the attachment 3 is fastened to the lower end thereof. If the pole 1 has a plurality of pole tube portions 2, 2*a*, the attachment is secured to the lowermost pole tube portion 2 in each case.

In all figures, an attachment 3 according to a first exemplary embodiment is depicted, on the lower end whereof a rubber-elastic buffer 4 is detachably secured. In this exemplary embodiment, the buffer is mounted displaceably in an axial direction along the longitudinal axis of the pole S, which allows the user to choose between a first position with a tip 30 projecting beyond the rubber-elastic bearing surface or rolling surface 43, as depicted in FIG. 1, and a second position with a rubber-elastic bearing surface or with a tip 30 concealed in the buffer, as depicted in FIG. 2.

FIG. 1*a*-1*g* shows a buffer 4 secured to an attachment 3 for a pole 1 in its upper position, as shown by the arrow. The tip 30 in this case projects beyond the rolling surface 43.

The rubber-elastic buffer 4 has an asymmetric design in this case, wherein the rolling surface 43 is drawn forwards further upwards in the running direction V, in order to be optimally adapted to the running direction during Nordic walking. The tip 30 passes through this rolling surface 43 roughly in the rear third. In addition, the profiling 44 has lateral extensions 46.

The buffer 4 in this case is fitted to an attachment 3 for a pole 1, wherein the attachment 3 in this preferred exemplary embodiment comprises an inner sleeve 26 mounted fixedly to the lower end of the pole tube 2 and an outer sleeve 28 that is axially displaceable on the inner sleeve. A securing element 31 is mounted on the inner sleeve 26, on the lower fastening lug 31*b* whereof a tip 30 is let in and secured. In the case of poles which have a simple replacement buffer which is not arranged in a height-adjustable manner for the purposes of penetration by a tip, the lower portion of the attachment 3 to which the buffer is detachably secured assumes the function of the lower portion 28*b* of the outer sleeve 28 depicted here and is configured accordingly.

Figure 1G:
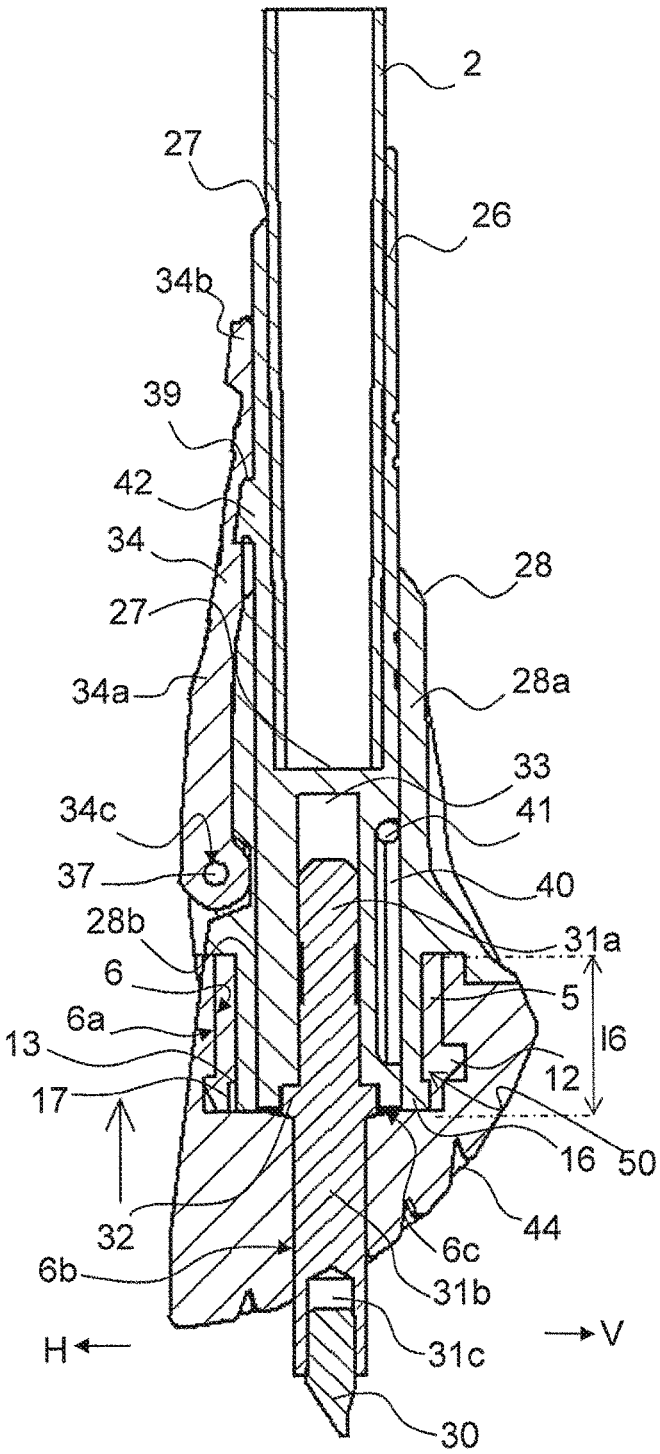
Figure 2G:
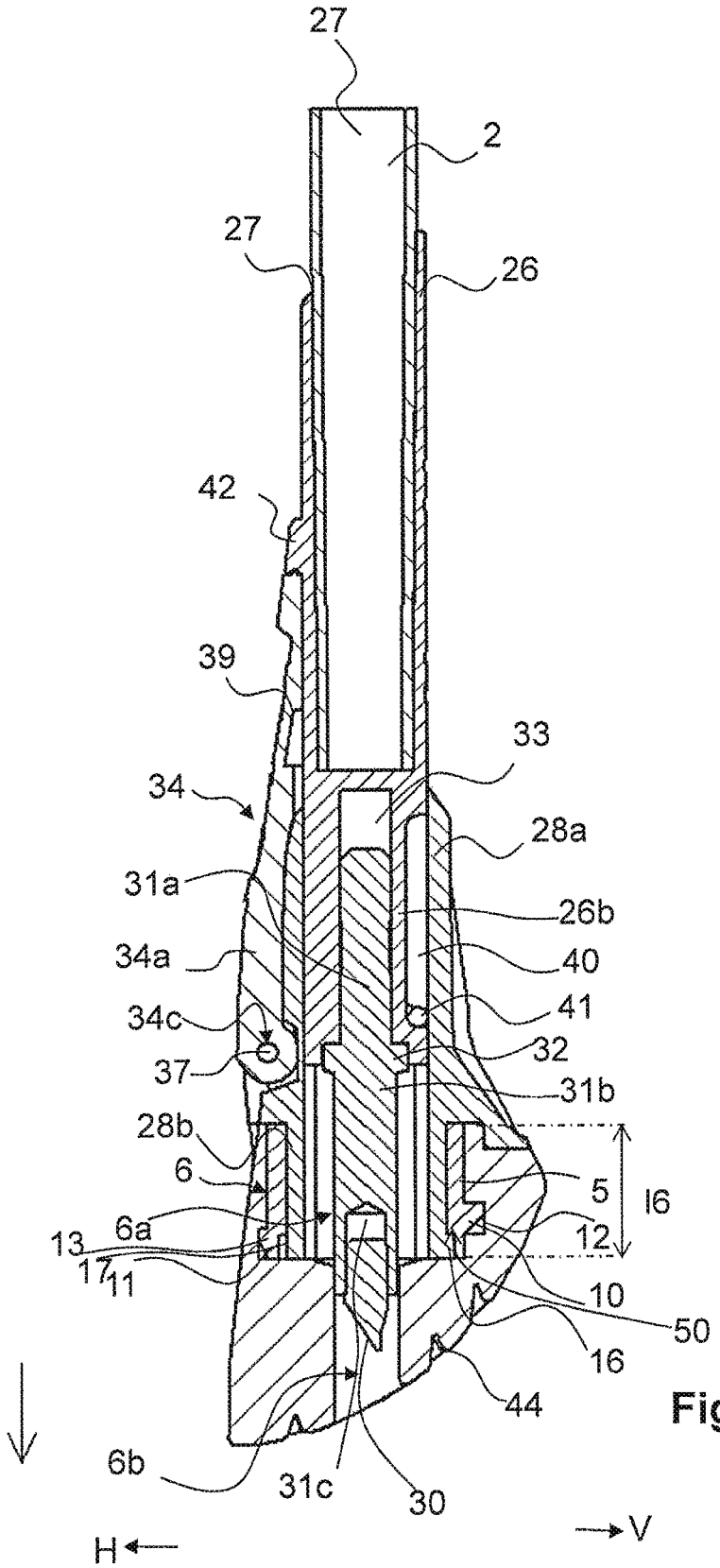
Figure 3A:
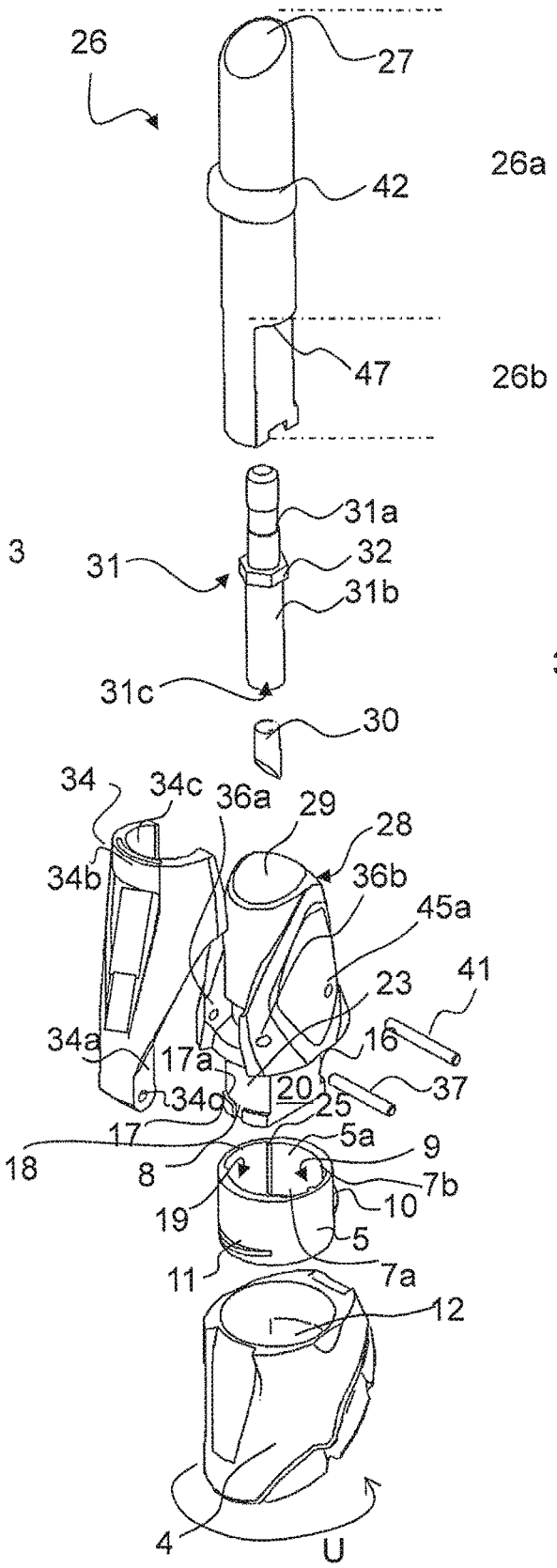
FIG. 3 shows in two different schematic representations a buffer according to the first exemplary embodiment, wherein 3 *a*) shows an exploded view in the running direction from rear right, 3*b*) shows an exploded view in the running direction from front right and 3*c*) shows an exploded view from the right in relation to the running direction.

The composition of the attachment 3 and the embodiment of the constituents thereof are shown particularly clearly in the exploded view in FIG. 3. The inner sleeve 26 has a central axial recess 27 in which the lower-end of a conically tapering pole tube 2 depicted in FIGS. 1*g*, 2*g* and 4 is pressed and/or adhered. The upper region of this inner sleeve 26 to a certain extent forms a sleeve which encloses the pole tube 2. The inner sleeve 26 has an upper portion 26*a* which creates this sleeve and is used to receive the pole tube 2 and also to safeguard the form-fitting connection in the two positions of the outer sleeve 28. In addition, a lower portion 26*b* of the inner sleeve 26 follows which is configured downwardly and integrally with the upper portion 26*a*. On this lower portion 26*b*, the actual tip 30 made from a wear-resistant material such as metal, hard metal, ceramic or a combination of these materials, for example, is secured at the lower end. The securing is not direct but via a securing element 31 which is typically made of metal or hard plastic.

The lower portion 26*b* of the inner sleeve 26 has an axial recess 33 in which an upper securing stub 31*a* of the securing element 31 is let in or else secured. A hexagonal flange 32 in this exemplary embodiment which is integrally configured with the upper and lower securing stub 31*a* and which is still fastened in the lower portion 26*b* of the inner sleeve 26 separates the upper securing stub 31*a* from a lower securing stub 31*b* of the securing element 31 which penetrates the buffer 4 by means of the through-opening 6. The hexagonal shape of the flange 32 serves to secure the rotational position of the securing element 31 in the inner sleeve 26. As an alternative to this, however, the distortion-proof securing of the securing element 31 in the inner sleeve 26 may also be achieved by another non-circular embodiment of the flange 32 or of the upper securing stub 31*a*, by injection-molding, pressing-in, knurling the shaft or a combination of these measures. At the lower end of the lower portion 26*b* of the inner sleeve 26 there is a recess 49 for receiving a portion of the flange 32 which is configured in the shape of a hexagonal geometric profile in this case. The lower portion 26*b* of the inner sleeve 26 has a shape on its outer lateral surface which in this case substantially corresponds to the matching shape of the inner side of the lower portion 28*b* of the outer sleeve 28 and has only slightly smaller dimensions, so that the outer sleeve 28 is displaceable without radial play along the longitudinal pole axis S axially on the inner sleeve.

Both the lower portion 28*b* of the outer sleeve 28*b* and also the lower portion 26*b* of the inner sleeve 26, which fits in the lower portion 28*b* of the outer sleeve 28 and is mounted therein in an axially displaceable manner, is not circular in design in the present exemplary embodiment, but instead configured as an originally cylindrical laterally flattened area, so to a certain extent as a flat cylinder, which has a greater width in the running direction than perpendicularly to the running direction. The lower portion 28*b* therefore has a planar first right wall 20 and a planar second left wall, and also a curved third front wall 22 and a curved fourth rear wall 23.

Figure 3B:
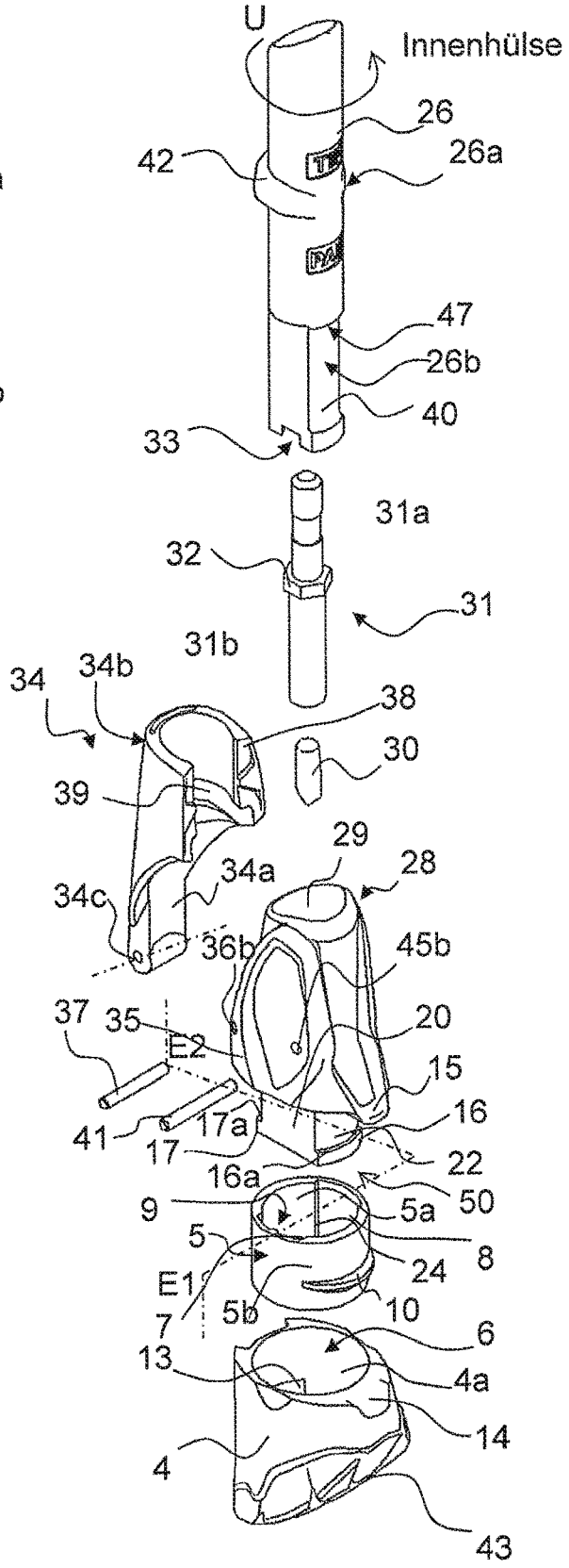

The flange 32 constitutes a defined lower abutment point for the position in which the tip 30 projects downwards beyond the rolling surface 43 (cf. in particular, the sectional depiction in accordance with FIG. 3*b*) and lies in an extended position of the tip 30 with its underside on a contact surface on the base 6*c* of the central recess 6 of the buffer 4.

The actual separate tip 30 made of a hard material, as described above, is pressed in and/or adhered or fixed in some other manner (soldered, screwed, etc.) into the lower securing stub 31*b* which has a downwardly facing recess 31*c*. The entire lower securing stub 31*b* and the tip 30 in this case have a cross-sectional shape which is adapted to a through-opening provided, in the flexible buffer 4, so that in different positions of the outer sleeve 28 relative to the inner sleeve 26 the tip 30 can be displaced through this through-opening 6. The through-opening 6 in the buffer 4 is therefore configured in an upper portion 6*a* which is designed to receive the insert 5 with a greater diameter than in the lower portion 6*b* which is designed to receive the tip 30. The through-opening 6 is therefore designed to taper downwards to the rolling surface.

An outer sleeve 28 is arranged on the lower portion 26*b* of the inner sleeve 26 mounted displaceably in the axial direction. A latching lever 34 is articulated on the outside of this outer sleeve 28, which lever has two bearing extensions 35 of the outer sleeve 28 formed towards the back in the running direction which have two aligned axial holes 36*a*, 36*b*. The latching lever 34 is secured between these two bearing extensions 35. For this purpose, a tapered region 34*a* of the latching lever 34 engages between the two bearing extensions 35, which region has a through-opening 34*c*. A rotational axis 37, typically a metal pin, is inserted through the two axial holes 10 and this through-opening 34*c*, so that the latching lever 34 is pivotably mounted about this rotational axis 37 on the outer sleeve 28.

At its upper end, this latching lever 34 has a clamp region 34*b*. With this clamp region 34*b* the latching lever 34 embraces the upper portion 26*a* of the inner sleeve 26 in a self-latching manner in the fixed position of the buffer 4. On the inside of this clamp region 34*b*, for precise fixing of the form-fitting connection in both positions, on the one hand there is a radially inwardly extending bearing region 38 arranged on the inside on the circumference and an undercut 39 within the meaning of a similarly circumferential groove following directly below.

The axial displaceability of the outer sleeve 28 is furthermore ensured by a guide recess 40 provided in the lower region 26*b* of the inner sleeve 26 which has an elongate design in the axial direction. A transversely running guide pin 41 which is secured in the outer sleeve 28 engages with this guide recess 40 which is to a certain extent formed as an undercut of the lower portion 26*b* of the inner sleeve 26 and only forms an elongate hole following insertion into the outer sleeve 28. In the lower position of the outer sleeve 28, as can be seen in particular with the help of FIG. 2*g*, this guide pin 41 rests on the lower abutment point of the guide recess 40. On the other side, the bearing region 34*b* of the latching lever 34 engages from below in a form-fitting manner with a circumferential latching extension 42 in the upper portion 26*a* of the inner sleeve 26. Accordingly, in the lower position of the outer sleeve 28, as shown in FIG. 2, the outer sleeve 28 is fixed in this position, whereby one abutment is created by the relative position of the guide pin 41 in the guide recess 40 on the lower abutment and on the other side by the bearing of the bearing region 34*b* of the latching lever 34 on the lower surface of the latching extension 42.

In this design the detachably secured buffer 4 is provided on the underside of the outer sleeve 28. From the, to a certain extent, lower position of the outer sleeve 28 relative to the inner sleeve 26, as shown in FIG. 2, a buffer 4 of this kind can be displaced into the position with extended tip 30 according to FIG. 1, whereby the latching lever 34 is pivoted laterally outwards, so that the bearing portion 34*b* releases the latching extension 42. The outer sleeve 28 can then be (successively) displaced upwards within the framework of the movability of the guide pin 41 in the guide recess 40.

FIG. 1 depicts the position in which the outer sleeve 28 has been pushed through the abutment of the axial movability predefined by the recess 27 or the guide pin 41 and the latching lever 34 has again been placed onto the inner sleeve 26 and has snapped around the inner sleeve 26 in a self-latching manner to a certain extent. In this upper position of the outer sleeve 28, the bearing region 34*b* now lies above the latching extension 42 and the latching extension 42 engages with the undercut 39 in a form-fitting manner. In this position the upper region of the latching lever 34 therefore defines a complete form-fitting securing and the lower abutment, predefined by the guide recess 40 or else the guide pin 41, is not absolutely necessary but is possible.

The buffer 4 in the exemplary embodiment shown is secured by means of a bayonet lock 50 to the attachment 3. In the case of a variant with axial displaceability of a buffer 4 that can be slid over a tip 30, the buffer is secured on the lower portion 28*b* of the outer sleeve 28. To achieve this, the buffer 4 is slipped onto the lower portion of the attachment 3 or on the lower portion 28*b* of the outer sleeve 28 and then turned by a rotation of the buffer 4 relative to the attachment 3 or the outer sleeve 28 into the abutment/latching position and therefore secured on the pole 1. The bayonet connection provided by the bayonet lock 50 is made between the insert 5 introduced in the buffer 4 made of hard plastic and the attachment 3 or else the outer sleeve 28. The slip-on position is defined by the front radial projection 16 and the rear radial projection 17 on the lower portion of the attachment 3 or of the outer sleeve 28 and in particular by the axial gap 18 on the rear radial projection 17 for receiving the axial rib 9 of the insert 5. If, after the buffer 4 has been fitted in the slip-on position, the buffer 4 is locked, in the exemplary embodiment shown in FIGS. 1-3 the pole tube 2 with the attachment 3 is turned clockwise in the circumferential direction U through an angle range of 90-120 degrees up to the abutment of the front radial projection 16 on a right abutment 25 of the first recess 7 in the insert 5 and of the rear radial projection 17 on a right abutment of the second recess 8 in the insert 5.

Figure 3C:
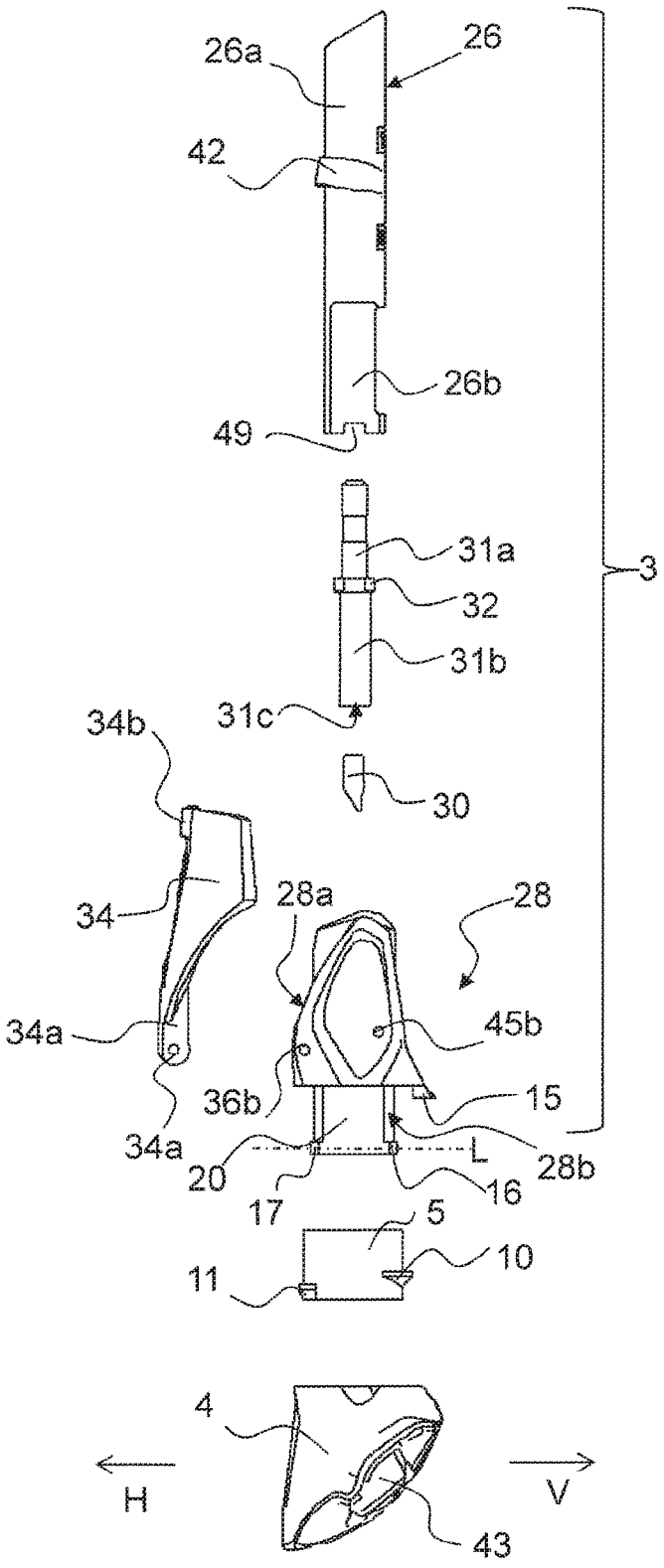

For this purpose, the radial projections 16, 17 of the lower portion 28*b* of the attachment 3, which are depicted in FIG. 3*c*, each run in the insert 5 of the buffer 4 to a certain extent in a rail which is created by a correspondingly formed recess or a notch or groove in the inner wall 5*a* of the cylindrical insert 5. This notch is, as previously described, formed by the leg of the L-shaped recess running in the circumferential direction U of the insert 5.

In the case of an alternative exemplary embodiment of a pole which either has no tip at all, but only a rubber-elastic buffer (with or without a tip body fixedly installed thereon), the attachment is simply used for the form-fitting connection of the lowermost pole tube portion to the buffer. The attachment may, however, also have a tip body fixedly installed thereon or exchangeably mounted thereon, wherein the detachably securable buffer is slipped over this tip body. With a multi-part attachment, the tip body can either be exposed by an axial displacement of the buffer along with a lower part of the attachment relative to an upper part of the attachment or else extend beyond the rolling surface (as shown in FIG. 1) or be concealed in the inside of the buffer (as shown in FIG. 2).

LIST OF REFERENCE NUMBERS

| | |
|---|---|
| 1 | Pole |
| 2 | Lowermost pole tube portion |
| 2a | Upper pole tube portion |
| 3 | Attachment |
| 4 | Buffer |
| 4a | Inner wall of 4 |
| 5 | Insert in 4 |
| 5a | Inner wall of 5 |
| 5b | Outer wall of 5 |
| 6 | Central recess in 4 |
| 6a | Upper portion of 6 |
| 6b | Lower portion of 6 |
| 6c | Base of 6 |
| 7 | First recess in 5 |
| 7a | First half of 7 |
| 7b | Second half of 7 |
| 8 | Second recess in 5 |
| 9 | Axial rib of 5 in 7 |
| 10 | Front flange on 5 |
| 11 | Rear flange on 5 |
| 12 | First recess in 4a for 10 |
| 13 | Second recess in 4a for 11 |
| 14 | Third recess in 4 for 15 |
| 15 | Axial lug on 3 or 28b |
| 16 | Front radial projection on 3 or 28b |
| 16a | Upper edge of 16 |
| 17 | Rear radial projection on 3 or 28b |
| 17a | Upper edge of 17 |
| 18 | Axial gap in 17 for 9 |
| 19 | Through-opening in 5 |
| 20 | First right wall of 3 |
| 22 | Third front wall of 3 |
| 23 | Fourth rear wall of 3 |
| 24 | Left abutment of 7 |
| 25 | Right abutment of 8 |
| 26 | Inner sleeve |
| 26a | Upper portion of 26 |
| 26b | Lower portion of 26 |
| 27 | Upper central axial recess in 26 for 2 |
| 28 | Outer sleeve |
| 28a | Upper portion of 28 |
| 28b | Lower portion of 28 |
| 29 | Central axial recess of 28 |

-continued

Figure 1A:
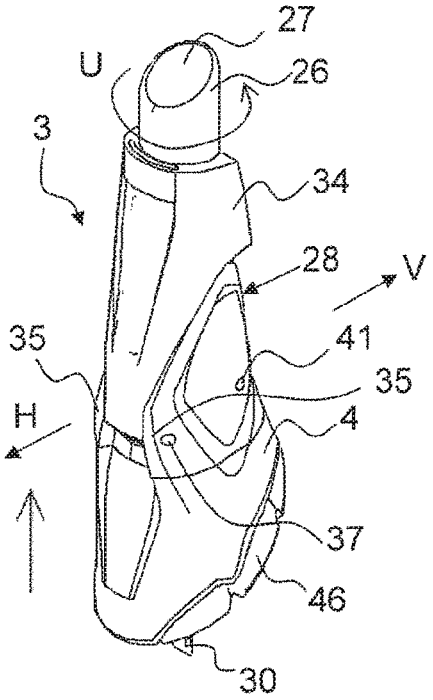
FIGS. 1*a*) to 1*f*) show in different schematic representations a buffer according to a first exemplary embodiment in the fixed position in which the tip projects downwards beyond the rolling surface, wherein 1*a*) shows a perspective view in the running direction from rear right, 1*b*) shows a perspective view in the running direction from front right, 1*c*) shows a view in the running direction from the front. 1*d*) shows a side view in the running direction from the right, 1*e*) shows a view in the running direction from the rear. 1*f*) shows the view from the front with the sectional plane/plane of symmetry A-A, and 1*g*) shows a section along A-A in FIG. 1*f*), wherein in FIGS. 1*f* and 1*g* the lowermost pole tube portion is depicted.
Figure 1B:
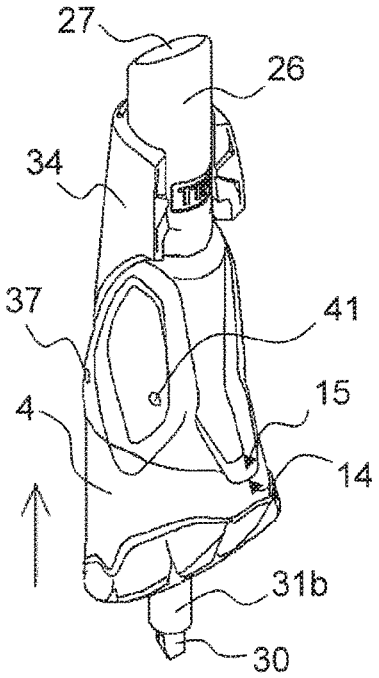
Figure 1C:
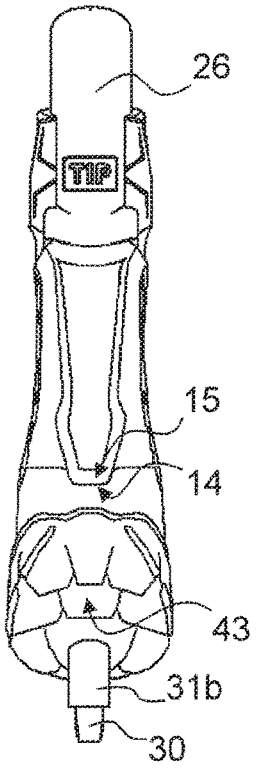
Figure 1D:
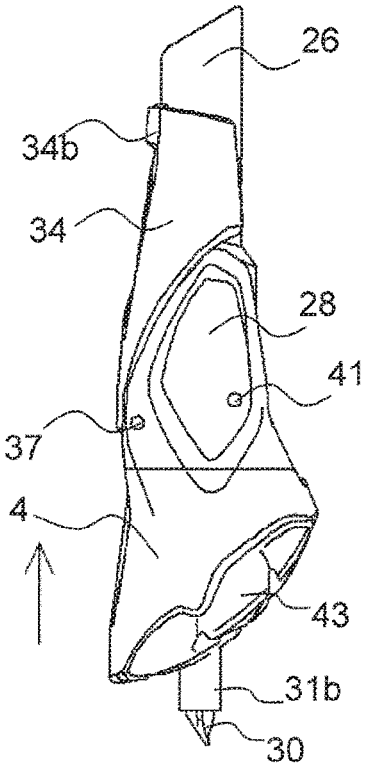
Figure 1E:
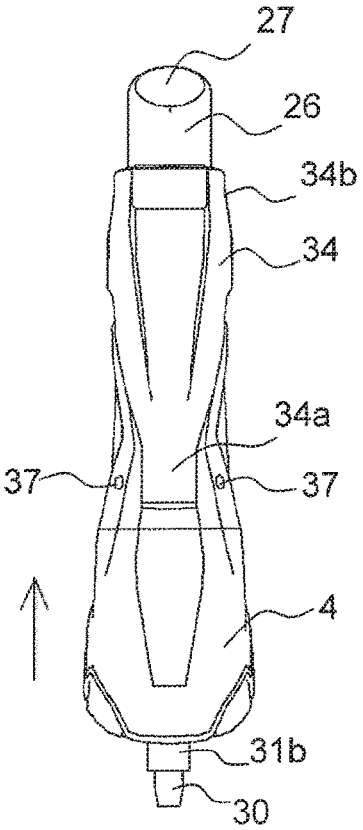
Figure 1F:
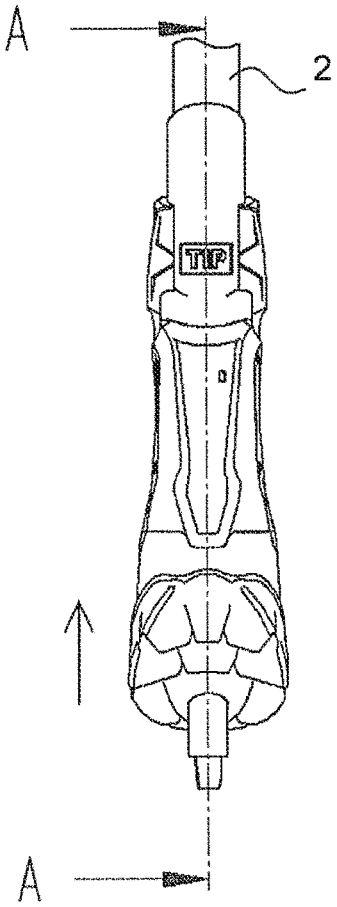
Figure 2A:
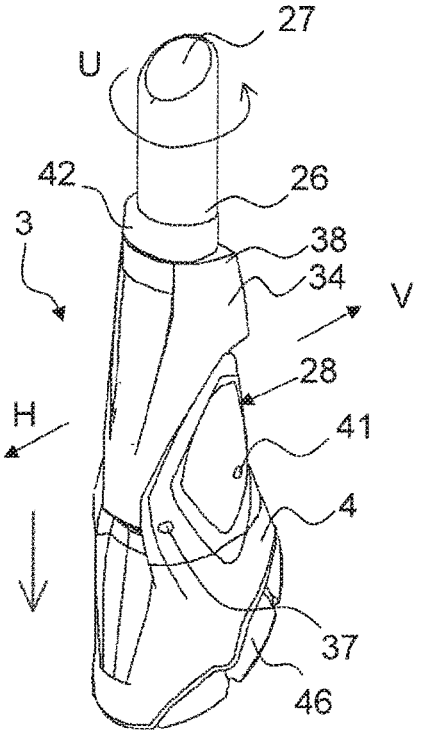
FIGS. 2*a*) to 2*g*) show in different schematic representations a buffer according to the first exemplary embodiment in the position in which the tip is concealed, wherein 2*a*) is a perspective view in the running direction from rear right, 2*b*) is a perspective view in the running direction from front right, 2*c*) is a view in the running direction from the front, 2*d*) is a side view, 2*e*) is a view in the running direction from behind, 2*f*) is the view from the front with the sectional plane/plane of symmetry A-A, and 2*g*) shows a section along B-B in FIG. 2*f*, wherein in FIGS. 2*f* and 2*g* the lowermost pole tube portion is depicted.
Figure 2B:
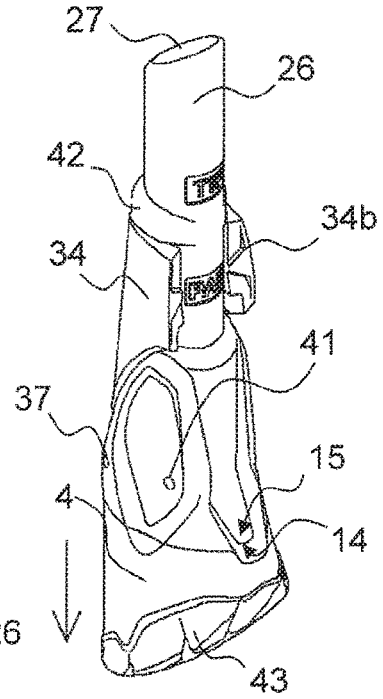
Figure 2C:
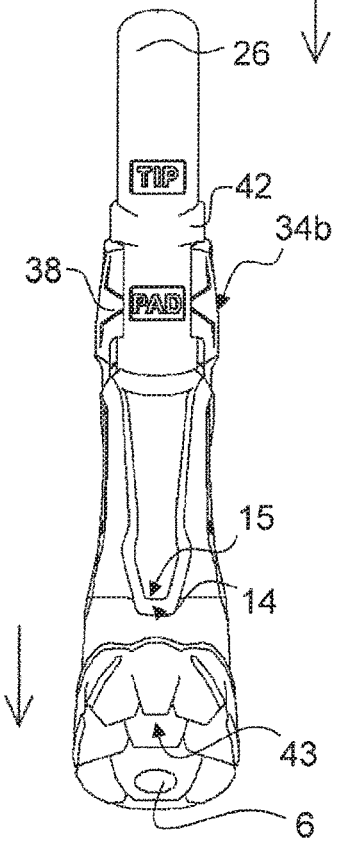
Figure 2D:
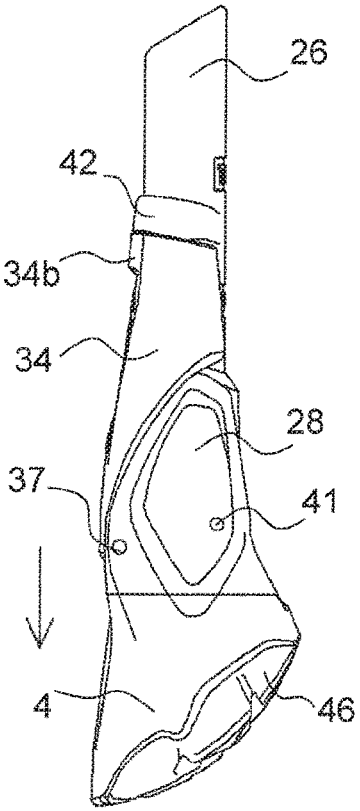
Figure 2E:
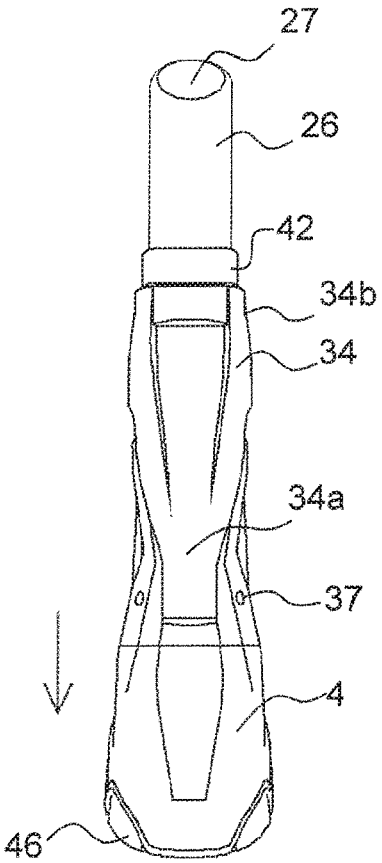
Figure 2F:
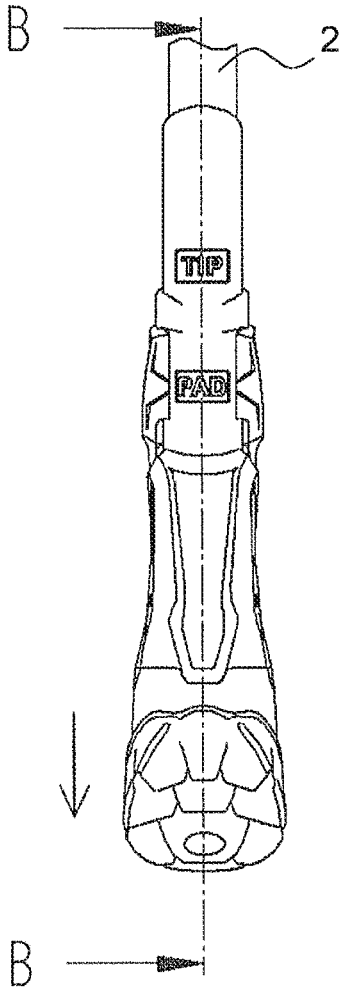

| LIST OF REFERENCE NUMBERS | |
|---|---|
| 30 | Tip |
| 31 | Securing element for 30 |
| 31a | Upper fastening stub of 31 |
| 31b | Lower fastening stub of 31b |
| 31c | Lower central axial recess in 31 |
| 32 | Circumferential flange on 31 |
| 33 | Axial recess in 26b for 31a |
| 34 | Latching lever |
| 34a | Tapered region of 34 |
| 34b | Clamp region of 34 |
| 34c | Through-opening of 34a |
| 35 | Bearing extension of 28 |
| 36a | Left axis hole in 28 |
| 36b | Right axis hole in 28 |
| 37 | Rotational axis in 28, cross pin through 34c |
| 38 | Extended bearing region of 34b |
| 39 | Undercut, groove in 34b |
| 40 | Guide recess |
| 41 | Guide pin in 28 |
| 42 | Latching extension of 26 |
| 43 | Rolling surface of 4 |
| 44 | Profiling in 43 |
| 45a | Left through-opening for 41 in 28 |
| 45b | Right through-opening for 41 in 28 |
| 46 | Lateral extensions of 44 |
| 47 | Shoulder between 26a, 26b |
| 48 | Pole handle |
| 49 | Recess in 26b for 32 |
| 50 | bayonet lock. |
| A-A | Sectional plane in FIG. 1f, axial plane of symmetry of 4 |
| B-B | Sectional plane in FIG. 2f, axial plane of symmetry of 4 |
| E1 | Bisecting plane of 5 |
| E2 | Bisecting plane of 3 |
| H | Against the running direction, rearwards |
| L | Longitudinal direction of 28b |
| 16 | Length of 6a |
| S | Longitudinal axis of the pole |
| U | Circumferential direction |
| V | Running direction, forwards |

The invention claimed is:

1. A pole having a pole tube, on the lower end whereof is provided an attachment to which a buffer made of rubber-elastic material is detachably secured, wherein the underside of the buffer forms a profiled rolling surface, wherein the buffer has an insert made of hard material, which is secured in a central recess of the buffer, which recess is upwardly open in a direction to the attachment of the pole, wherein the buffer is formed as a two-part component having said insert of inflexible hard material as securing region and a rubber elastic region forming said rolling surface;

wherein the buffer is detachably fastened to the attachment by means of a bayonet lock between the insert and an outer sleeve of the attachment, wherein said bayonet lock is provided in that the insert of the buffer has at least a first recess on an inner wall of the insert for receiving at least a first radial projection which is arranged on a lower portion of said outer sleeve facing the buffer, wherein the attachment comprises an inner sleeve secured to the pole tube, wherein said outer sleeve encloses the inner sleeve and is mounted thereon in an axially displaceable manner, wherein the attachment is provided with a tip, wherein the tip and/or a lowermost portion of the inner sleeve is/are arranged passing through the central recess in the buffer and a central recess in the insert, wherein the buffer is mounted displaceably so that it can be fixed in an axial direction along a longitudinal axis of the pole in this central recess, and wherein the buffer can be locked in at least two axially different positions via a form-fitting connection in respect of the pole tube or inner sleeve.

2. The pole as claimed in claim 1, wherein the buffer can be secured in only a single rotational position on the attachment of the pole, wherein the attachment and/or the buffer has a distortion lock to prevent rotation of the buffer in respect of the attachment in a state fitted to the pole.

3. The pole as claimed in claim 1, wherein the attachment has a lower portion facing the buffer, the cross section whereof is not circular.

4. The pole as claimed in claim 3, wherein the lower portion has a greater width in a running direction than in a direction perpendicular to the running direction.

5. The pole according to claim 1, wherein said lower portion of said outer sleeve has a second radial projection opposite said first radial projection and the insert of the buffer has a second recess opposite said first recess on an inner wall of the insert, and wherein in a secured position of the buffer on the attachment, a bisecting sectional plane of the attachment arranged along the longitudinal axis of the pole, which sectional plane runs through the two radial projections, is distorted in the circumferential direction in relation to a bisecting sectional plane of the insert running along the longitudinal axis of the plane, which sectional plane runs through two recesses lying opposite one another, wherein the bisecting sectional plane of the attachment running along the longitudinal axis of the pole runs parallel to a running direction.

6. The pole according to claim 1, wherein each radial projection on a lower portion of the attachment reaches below a shoulder running in the circumferential direction on the inner wall of the insert of the buffer secured to the attachment, wherein the respective shoulder forms on the inner wall of the insert an upper abutment for the respective projection of the attachment.

7. The pole as claimed in claim 1, wherein the attachment has a projection extending in the direction of the longitudinal axis of the pole up to the buffer which engages with a corresponding recess on an outside of the buffer secured to the attachment.

8. The pole as claimed in claim 7, wherein the projection extending in the direction of the longitudinal axis of the pole up to the buffer is an axial lug, which engages with a corresponding third recess on an outside of the buffer secured to the attachment.

9. The pole as claimed in claim 1, wherein the central recess in the buffer is a blind hole.

10. The pole as claimed in claim 9, wherein an upper portion of the central recess is substantially cylindrical in design, and wherein the buffer has on its inner wall at least one, or a plurality of, recesses in the circumferential direction and at different axial positions along the length of the upper portion of the central recess of the buffer for receiving a radial flange arranged on an outer wall of the insert, extending sectionally in the circumferential direction.

11. The pole as claimed in claim 1, wherein the buffer is configured asymmetrically, wherein the buffer, measured parallel to the longitudinal axis of the pole, viewed in a front region in a running direction, has a shorter length than in a rear region.

12. The pole as claimed in claim 1, wherein the attachment has a tip, which is arranged passing through a central recess of the buffer and of the insert, and wherein the tip or the buffer can be locked at at least two axially different positions via a form-fitting connection.

13. A buffer for a pole as claimed in claim 1, wherein the buffer has a region made of rubber-elastic material that provides a form fit of the lowermost pole tube to the buffer.

14. The buffer as claimed in claim 13, wherein the insert made of hard material is secured, by form-fitting and/or force-fitting to the buffer.

15. A buffer for a pole as claimed in claim 1, wherein the buffer can be secured in only a single rotational position on the attachment of the pole, and wherein the buffer has a distortion lock to prevent rotation of the buffer in respect of the attachment in a state fitted to the pole.

16. A buffer for a pole as claimed in claim 1, wherein the central recess is a through-opening for receiving a pole tip, wherein an upper portion of the central recess in which the insert is secured has a greater diameter than a lower region of the recess facing a rolling surface of the buffer, and wherein the insert has a lower abutment on a boundary surface of the buffer between the larger-diameter upper portion and the smaller-diameter lower portion of the central recess.

17. A buffer for a pole as claimed in claim 1, wherein the insert is inserted in a rotational position in the central recess of the buffer, in which two radially opposite recesses of the insert lie opposite in the circumferential direction of the pole twisted in respect of a running direction.

18. The pole as claimed in claim 16 in the form of a Nordic walking pole.

19. The pole as claimed in claim 1, wherein the insert of the buffer is configured as a hollow cylinder, and has in addition a second recess radially opposite the first recess for receiving a second projection radially opposite the first projection, and wherein the second recess is bisected in the circumferential direction by an axial rib extending along the longitudinal axis of the pole only incompletely over an axial length of the insert on the inner wall and the second projection of the attachment is interrupted by an axial gap which is suitable for receiving the axial rib of the insert.

20. A buffer for a pole as claimed in claim 1, in which there are two radially opposite recesses of the insert which lie opposite in the circumferential direction of the pole twisted by 45-90 degrees in respect of a running direction.

21. A pole having a pole tube, on the lower end whereof is provided an attachment to which a buffer made of rubber-elastic material is detachably secured, wherein the underside of the buffer forms a profiled rolling surface, wherein the buffer has an insert made of hard material which is secured in a central recess of the buffer, which recess is upwardly open in a direction to the attachment of the pole, wherein the buffer is formed as a two-part component having said insert of inflexible hard material as securing region and a rubber elastic region forming said rolling surface;

wherein the buffer is detachably fastened to the attachment by means of a bayonet lock between the insert and an outer sleeve of the attachment, and wherein said buffer is secured and locked to the outer sleeve of the attachment in said bayonet lock via a plug-in/rotate movement, in which the buffer with the insert is fitted to the lower portion of the outer sleeve of the attachment in a plug-in direction along the longitudinal axis of the pole and then rotated thereon involving a rotational movement of the insert relative to the outer sleeve of the attachment.

22. The pole as claimed in claim 21, wherein the attachment comprises an inner sleeve secured to the pole tube, wherein said outer sleeve encloses the inner sleeve and is mounted thereon in an axially displaceable manner, wherein the attachment is provided with a tip, wherein the tip and/or a lowermost portion of the inner sleeve is/are arranged passing through the central recess in the buffer and a central recess in the insert, wherein the buffer is mounted displaceably so that it can be fixed in an axial direction along a longitudinal axis of the pole in this central recess, and wherein the buffer can be locked in at least two axially different positions via a form-fitting connection in respect of the pole tube or inner sleeve.

23. The pole as claimed in claim 22, wherein a latching lever is articulated at its lower end facing a rolling surface of the buffer on the outside on the outer sleeve and at its upper end in the secured position of the buffer engages around the pole tube and/or the inner sleeve at least partially with a form fit and can be released by pivoting away from the outer sleeve.

24. A pole having a pole tube, on the lower end whereof is provided an attachment to which a buffer made of rubber-elastic material is detachably secured, wherein the underside of the buffer forms a profiled rolling surface, wherein the buffer has an insert made of hard material which is secured in a central recess of the buffer, which recess is upwardly open in a direction to the attachment of the pole, wherein the buffer is formed as a two-part component having said insert of inflexible hard material as securing region and a rubber elastic region forming said rolling surface;

wherein the buffer is detachably fastened to the attachment by means of a bayonet lock between the insert and the attachment, and wherein the insert has at least one L-shaped recess on an inner wall thereof with a wide neck extending parallel to the longitudinal axis of the pole and a narrower leg in the circumferential direction for receiving a radial projection which is arranged on a lower portion of the attachment facing the buffer.

* * * * *